US006953168B2

(12) United States Patent
Delille

(10) Patent No.: US 6,953,168 B2
(45) Date of Patent: Oct. 11, 2005

(54) SYSTEM FOR POSITIONING THE ROTOR AND INDEXING A PERCUSSIVE COMMINUTOR

(75) Inventor: Jean-Pierre Delille, Romanche-Thorins (FR)

(73) Assignee: Metso Minerals (Macon) S.A., Macon Cedex (FR)

( * ) Notice: Subject to any disclaimer, the term of this patent is extended or adjusted under 35 U.S.C. 154(b) by 141 days.

(21) Appl. No.: 10/388,439

(22) Filed: Mar. 17, 2003

(65) Prior Publication Data

US 2003/0178517 A1 Sep. 25, 2003

(30) Foreign Application Priority Data

Mar. 21, 2002 (FR) ..... 02 03524

(51) Int. Cl.[7] ..... B02C 4/34; B02C 11/08; B02C 23/00; B02C 4/32; B02C 7/14

(52) U.S. Cl. ..... 241/189.1; 241/37; 241/189.2; 241/286; 241/287

(58) Field of Search ..... 241/37, 189.1, 241/189.2, 286, 287

(56) References Cited

U.S. PATENT DOCUMENTS 3,768,743 A 10/1973 Smits
3,771,733 A * 11/1973 Hadley et al. ..... 241/186.35
4,084,752 A * 4/1978 Hagiwara et al. ..... 241/30
5,226,604 A * 7/1993 Seiffert et al. ..... 241/30
5,713,527 A * 2/1998 Hemesath et al. ..... 241/189.1
5,718,389 A * 2/1998 Finken et al. ..... 241/27

FOREIGN PATENT DOCUMENTS

DE 195 11 097 7/1996
EP 0 019 541 11/1980

* cited by examiner

*Primary Examiner*—Derris H. Banks
*Assistant Examiner*—Jason Y Pahng
(74) *Attorney, Agent, or Firm*—Young & Thompson

(57) ABSTRACT

The rotor (2) being operatively associated with an indexing member (13) in the form of a prism, coaxial and secured in rotation with the rotor, said indexing member having a number of projecting edges equal to the number of beaters (3), the indexing member being positioned on the axis of the rotor such that the application of the indexing plate (25) against the surface of the indexing member causes a rotation of the rotor (2) to a position in which one of the beaters is located at a position of maximum approach with the impact baffle (5), wherein approach of said baffle (5) into contact with the end of said beater (3) defines an origin of adjustment of the spacing ® between said baffle and said beater and thus the adjustment of said spacing for the desired granulometry.

13 Claims, 2 Drawing Sheets

SYSTEM FOR POSITIONING THE ROTOR AND INDEXING A PERCUSSIVE COMMINUTOR

BACKGROUND OF THE INVENTION

The invention relates to percussive comminutors or crushers adapted for installation in quarries or mines for the dimensional reduction of granulets or minerals. More particularly, it relates to a system for positioning the rotor of a percussive comminutor for its indexing so as to adjust spacing between the end of the beaters mounted on the rotor and the last impact baffle of the comminutor.

In a percussive comminutor, the granulets are introduced through a feed opening and then are struck by the beaters secured to the rotor and flung against the impact baffles located in the comminution chamber to have their dimensions reduced. Once introduced, the granulets are subjected to this process several times until the reach the size of the spacing of adjustment between the nearest end of the rotor of the last impact baffle and the end of the beaters. Once this dimension is reached, the reduced granulet passes between the beaters and the baffle and is evacuated through the outlet.

One of the problems connected with these machines, is the adjustment of the spacing R between the end of the beaters and the edge of the last impact baffle, which is nearest the rotor. This spacing R is modified by the wear of the beaters in the course of the comminuting process and must be readjusted periodically to keep a regular granulometry. Moreover, it must be pre-regulated with each comminuting process to be adjusted to the outlet granulometry that it sought.

This adjustment is often carried out manually by the operator, who must first of all stop the device, turn the rotor until the end of one of its beaters is nearest that of the last impact baffle, then proceed to a manual measurement of the distance between this end of the beater and that of the baffle and act on the hydraulic mechanism controlling the output of a positioning jack for the beater so as to obtain the desired distance.

SUMMARY OF THE INVENTION

The object of the present invention is thus to permit this adjustment of the spacing R between the last impact baffle and the beaters of the rotor without direct manual intervention of the operator, by indexing the position of the rotor for adjustment.

This object is achieved, according to the invention, with an indexing system of the rotor of the percussive comminutor, comprising a comminuting chamber, a rotor provided with beaters regularly spaced about its periphery and at least one impact baffle, of which one end is articulated on the frame of the machine, and can pivot about this articulation to approach or retreat from the rotor thanks to an adjustment jack, the baffle defining at the point of maximum approach with the radial end of one of its beaters, a spacing determining a given granulometry, in that the rotor comprises an indexing member in the form of a prism, coaxial and secured in rotation with it and having a number of edges equal to the number of beaters, this piece being positioned on the axle of the rotor such that the application in the plane defining two edges of a plate mounted at the end of an indexing jack rod, perpendicular to this rod, gives rise to a rotation of the rotor to a position in which the radial end of the beater corresponding to said edge is located at said position of maximum approach with the impact baffle, thereby permitting, by approach of said baffle by means of the adjustment jack in contact with the end of said beater, defining the origin of adjustment of the spacing between these two elements and thus adjusting said spacing for the desired granulometry.

BRIEF DESCRIPTION OF THE DRAWINGS

The invention will be better understood from the examples of embodiment shown in the accompanying drawings, in which.

DESCRIPTION OF THE PREFERRED EMBODIMENTS

Figure 1:
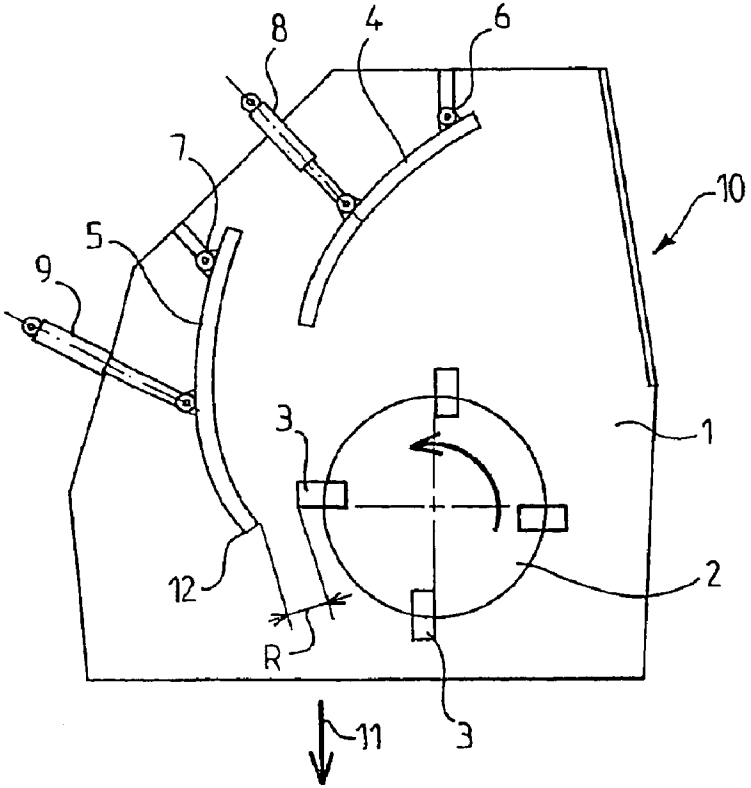
FIG. 1 PRIOR ART
FIG. 1 shows schematically in cross-section a comminutor of the conventional type.

The comminutor shown in FIG. 1 comprises a comminution chamber 1 in which rotates a rotor 2 provided with beaters 3 regularly spaced about its periphery. The example shown includes four beaters.

In the comminution chamber, are disposed impact baffles 4 and 5. The baffles 4 and 5 are articulated at one of their ends on axles 6, 7, respectively, secured to the wall of the comminution chamber 1. The baffles 4 and 5 can pivot about pivots 6 and 7 thanks to adjustment jacks 8 and 9, respectively, to move their free ends toward or away from the rotor.

The adjustment of the granulometry to be obtained for the material to be comminuted takes place by approaching or receding, as the case may be, the free end 12 of the last baffle 5 from the periphery of the rotor R through which the granulets will pass having reached the adjusted dimension.

The adjustment process for the granulometry takes place in the following manner.

The machine being stopped, the rotor is turned until the end of any beater 3 is located facing the end 12 of the last baffle 5. The distance R is measured, between this end and that of the beater 3 in question and, by means of the adjustment jack 9, the ends of one or the other are brought together or moved farther apart by pivoting the baffle about the axis 7 so as to obtain the desired spacing R.

To do this, the operator must himself turn the rotor, whose inertia is relatively great, until the end of a rotor comes into registry with the end of the baffle, then he must make a measurement of the spacing and finally, whilst continuing to measure this spacing, cause the baffle to pivot until the desired value R is obtained.

Figure 2:
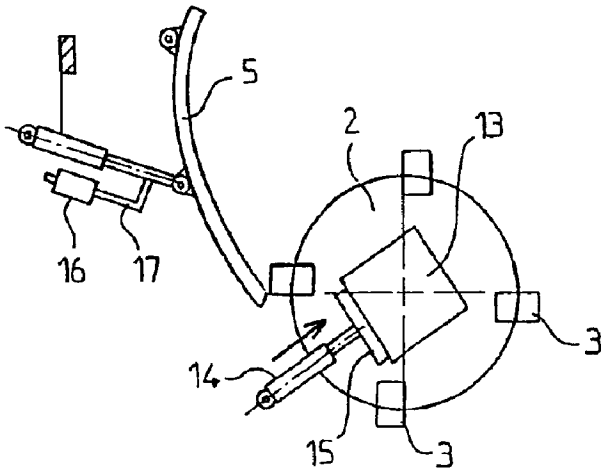
FIG. 2 shows schematically in cross-section a first example of embodiment of portions of the comminutor according to the invention.

The comminutor according to the invention, shown in FIG. 2, comprises, in addition to the parts described above, an indexing member 13 in the form of a prism with a square base mounted on the axle of the rotor and secured in rotation with it. Each edge of the indexing member 13 is associated with a beater of the rotor 2. An indexing jack 14, by which one end is connected to the frame of the machine, is provided at the free end of its rod with an indexing plate 15 perpendicular to said rod and is mounted so as to move radially toward the axis of the rotor.

On the other hand, the adjustment jack 9 of the baffle 5 is provided with a stirrup 17, mounted secured to its rod and parallel to it, sliding in a guide sleeve 16 provided with a position detector, so as to indicate the position of the jack.

The adjustment of the spacing R corresponding to the desired granulometry takes place according to the invention in the following manner:

The machine being stopped, the indexing jack 14 is deployed and its rod causes the indexing plate to advance toward the axis of the rotor 2 until it comes into contact with the indexing member 13. Most often, the indexing member 13 will not present one of its faces parallel to the indexing plate 15 and this latter will thus press on the nearest edge, under the force of the jack, and cause the rotor 2 to turn until the plate 15 is applied flat against the surface of the indexing member 13. In this position of the rotor, the beater 3 corresponding to the pressed edge of the member 13 has its radial end at the maximum point of approach to the free end of the baffle 5. The operator thus actuates the adjustment jack 9 to bring this end toward that of the rotor until they enter into contact. There is thus determined the origin (zero point) of the measurement of the spacing R. He then actuates the adjustment jack 9 in the reverse direction until his measurement instrument of the movement of the jack indicates the corresponding value of the desired spacing R, which is to say indicates a given granulometry.

As can be seen, the number of edges of the indexing member 13 is the same as the number of beaters 3.

Figure 3:
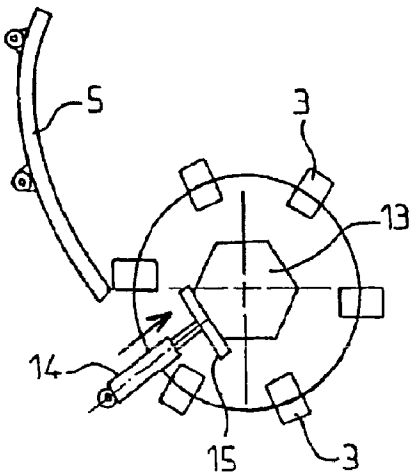
FIG. 3 shows schematically in cross-section a second example of an embodiment of portions of the comminutor according to the invention.

FIG. 3 shows a second embodiment of the invention in which the indexing member is a prism with a hexagonal base.

In this example, the system is the same, the number of indexing positions being six in this case.

Figure 4:
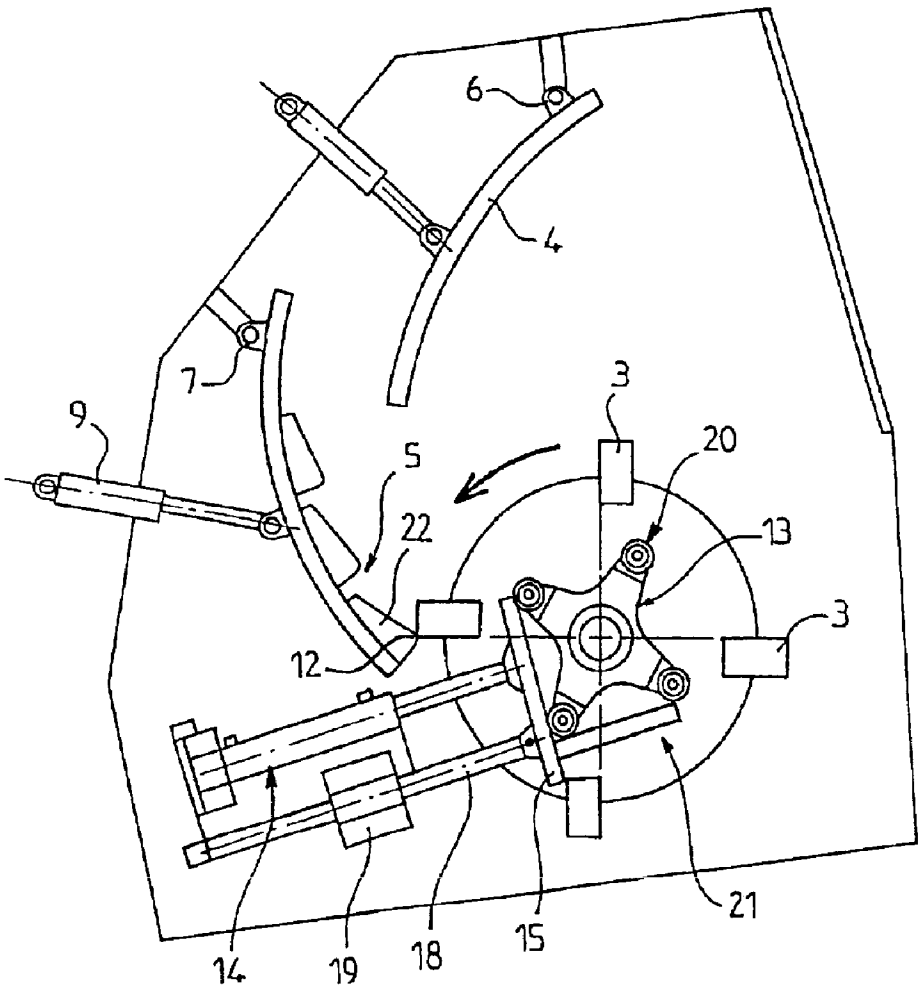
FIG. 4 shows schematically in cross-section a third example of embodiment of the comminutor according to the invention.

A third embodiment is shown in FIG. 4.

In the preceding examples, it is possible, although rare, that the rotor will be stopped such that one of the edges of the prisms constituting the indexing piece 13 is exactly on the axis of the indexing jack 14. In this case, the extension of the jack will be blocked because the rotor will not turn to present one of the surfaces of the indexing member 13 parallel to the indexing plate 15. It will then be necessary to give the rotor a slight pre-rotation such that the plate 15 can itself cause this rotation to continue until it is applied exactly against the surface of the piece 13.

To overcome this drawback, according to this embodiment, the indexing member 13 is constituted by a prism with a star-shaped base, with four legs in the example, the points of the legs of the star being provided with rollers 20 facilitating the sliding of said point on the indexing plate 15.

The indexing jack is provided with a guide stirrup 18, mounted securely on its rod and parallel to it, sliding in a guide sleeve 19, so as to prevent a rotation of the rod of the jack during its operation.

The system according to this embodiment operates as do the preceding embodiments.

When the machine is stopped, the operating actuates the indexing jack 14. The indexing plate 15 enters into contact with one of its rollers 20 against the indexing member 13 which rolls on the plate and the corresponding leg is urged causing the rotor 2 to turn until the roller of the following leg arrives also into contact with the indexing plate, the latter then being in the plane defined between the rollers 20 surmounting the edges of the prism.

In this position of the rotor, the end of the beater 3 associated with the first or the second leg of the indexing member 13 is disposed in the position of maximum approach to the impact baffle.

As in the preceding examples, the operator then actuates the last adjustment jack 9 to bring the baffle 5 into contact with the external radial end of the beater 3 to define the origin of the measurement of spacing R. By actuating the adjustment jack 9 in the other direction, the operator controls the spacing R to the value corresponding to the desired granulometry.

In this example, there are shown wear members 22 disposed at the exposed surface of the impact baffle 5. These wear members permit prolonging the lifetime of the baffle.

It has also been provided in this example, for the case in which, upon stopping the rotor 2, the urged leg of the indexing member 13 is located aligned with the axis of the indexing jack 14, a finger 21 disposed on the indexing plate 13 parallel to the rod of the jack. This finger 21 is so disposed and of a length such that when a leg of the indexing member 13 is aligned with the rod of the indexing jack 14, it comes to bear against an adjacent leg and causes the rotor to turn to permit the leg in question to be pressed by the indexing plate 15.

The illustrated example show an indexing member 13 formed by a prism whose base is a star with four legs. It follows that, as in the preceding cases, the number of beaters 3 could be increased and hence a prism could be used whose base star has six legs or more.

A programmable computer or any other similar system can be used to carry out automatically all the sequences of adjustment after having entered the adjustment of the spacing R to the value desired by the operator.

What is claimed is:

1. An indexing system for a percussive comminutor, the system comprising:

a comminuting chamber, a rotor having beaters regularly spaced about a periphery of the rotor, at least one impact baffle, of which one end is pivoted and another end is movable toward or away from the rotor by operation of an adjustment jack, the baffle defining at the point of closest approach with the radial end of one of the beaters a spacing (R) which determines a given granulometry, the rotor being operatively associated with an indexing member (13) in the form of a prism, coaxial and secured in rotation with the rotor, said indexing member having a number of projecting edges equal to the number of beaters (3), an indexing jack (14) having a rod with an indexing plate (15) that is mounted on an end of the rod and that is movable into contact with a surface of the indexing member, the indexing member being positioned on the axis of the rotor such that application of the indexing plate (15) against the surface of the indexing member causes a rotation of the rotor (2) to a position in which one of the beaters is located at a position of maximum approach with the impact baffle (5), wherein approach of said baffle (5) into contact with the end of said beater (3) defines an origin of adjustment of the spacing (R) between said baffle and said beater and thus the adjustment of said spacing for the desired granulometry.

2. The indexing system according to claim 1, wherein the indexing member (13) is square.

3. The indexing system according to claim 1, wherein the indexing member (13) is hexagonal.

4. The indexing system according to claim 1, wherein the indexing member (13) is star-shaped.

5. The indexing system according to claim 4, wherein the indexing member comprises plural legs and the indexing plate (15) comprises a finger (21) that is separate from the rod of the indexing jack and that is arranged to push one of the plural legs to cause the rotor (2) to turn.

6. The indexing system according to claim 1, wherein the indexing jack (14) is provided with a guide stirrup (18) that is secured to the rod and parallel to the rod, and that is slideable in a guide sleeve (19), so as to prevent rotation of the rod of the jack during operation.

7. The indexing system according to claim 2, wherein the indexing jack (14) is provided with a guide stirrup (18) that is secured to the rod and parallel to the rod, and that is slideable in a guide sleeve (19), so as to prevent rotation of the rod of the jack during operation.

8. The indexing system according to claim 3, wherein the indexing jack (14) is provided with a guide stirrup (18) that is secured to the rod and parallel to the rod, and that is slideable in a guide sleeve (19), so as to prevent rotation of the rod of the jack during operation.

9. The indexing system according to claim 4, wherein the indexing jack (14) is provided with a guide stirrup (18) that is secured to the rod and parallel to the rod, and that is slideable in a guide sleeve (19), so as to prevent rotation of the rod of the jack during operation.

10. The indexing system according to claim 5, wherein the indexing jack (14) is provided with a guide stirrup (18) that is secured to the rod and parallel to the rod, and that is slideable in a guide sleeve (19), so as to prevent rotation of the rod of the jack during operation.

11. The indexing system according to claim 1, wherein said rotor is round and said indexing member is one of a polygon and star-shaped and is interior to said beaters.

12. An indexing system for a percussive comminutor, the system comprising:

a rotor having plural beaters regularly spaced about a periphery of said rotor;

an impact baffle that has one pivoted end and an opposite end that is movable relative to said rotor, a point of closest approach of said opposite end of said impact baffle to said beaters defining a spacing that determines a granulometry for the comminutor;

said rotor carrying interior to said beaters an indexing member with a number of sides equal to a number of said beaters, said indexing member rotating with said rotor; and an indexing jack movably carrying an indexing plate, said indexing plate being movable into contact with one of said sides of said indexing member when said rotor has stopped rotating to cause said rotor to rotate further into a position where one of said beaters is at the point of closest approach to said opposite end of said impact baffle.

13. The indexing system of claim 12, wherein said rotor is round and said indexing member is one of a polygon and star-shaped.

* * * * *